US005893554A

United States Patent [19]

Okahashi et al.

[11] Patent Number: 5,893,554

[45] Date of Patent: Apr. 13, 1999

[54] SHEET FEEDING APPARATUS

[75] Inventors: Yoshitaka Okahashi, Kashihara; Tatsuya Inoue, Nara, both of Japan

[73] Assignee: Sharp Kabushiki Kaisha, Osaka, Japan

[21] Appl. No.: 08/928,638

[22] Filed: Sep. 12, 1997

[30] Foreign Application Priority Data

Sep. 13, 1996 [JP] Japan ..... 8-242742

[51] Int. Cl.[6] ..... B65H 3/14

[52] U.S. Cl. ..... 271/98; 271/104; 271/108; 271/171

[58] Field of Search ..... 271/98, 97, 94, 271/96, 104, 108, 171

[56] References Cited

U.S. PATENT DOCUMENTS

| | | | |
|---|---|---|---|
| 5,090,676 | 2/1992 | Matsuno et al. | 271/98 X |
| 5,135,213 | 8/1992 | Malachowski et al. | 271/98 X |
| 5,344,133 | 9/1994 | Jantsch et al. | 271/98 X |
| 5,429,348 | 7/1995 | Martin | 271/98 X |

FOREIGN PATENT DOCUMENTS 61-155139 7/1986 Japan .

9-58878 3/1997 Japan .

*Primary Examiner*—David H. Bollinger

[57] ABSTRACT

In order to prevent a situation that due to inherent variations in capability of a motor for a fan for blowing and sucking air, a motor for driving the suction transportation belt and the like, an external atmospheric pressure, and attaching of duct, the blowing force and the suction force upon the sheets become unstable, so that during suction attraction to the suction transportation belt, the sheets are not sucked parallel to the transportation direction but are sucked displaced, and therefore, a paper feeding error (jamming) results. An air blast nozzle for floating up the topmost sheet is disposed on the side to a sheet feeding cassette, and a suction transportation belt for suction attracting the topmost sheet is disposed above the sheet feeding cassette. A sheet pressing member is disposed above the sheet feeding cassette and a sheet rear end restricting plate. When the sheets have a small size which is smaller than a predetermined size, the sheet pressing member presses the topmost sheet at a rear end of the sheet from above and confines the sheet within a restricted area which is defined by the sheet rear end restricting plate and a sheet width restricting guide until the floated sheet is suction attracted to the suction transportation belt.

11 Claims, 9 Drawing Sheets

SHEET FEEDING APPARATUS

BACKGROUND OF THE INVENTION

1. Field of the Invention

The present invention relates to a sheet feeding apparatus for use in apparatuses such as a copying machine and a printer, which sucks and feeds sheet of papers, and more particularly, to a sheet feeding apparatus in which seat floating means floats one topmost sheet separately from a stack of sheets which is contained within sheet stacking means and suction transportation means sucks and feeds the floated sheet.

2. Description of the Related Art

In general, in a copying machine, a printer, etc., a sheet of paper is used as a paper on which an image is to be formed, a stack of sheets is housed in a sheet feeding cassette, and when an image is created, sheets are fed to a predetermined position for image creation one by one through a conveying path.

As a sheet feeding apparatus for feeding sheets one by one from a sheet feeding cassette, there are an apparatus which uses sheet feeding rollers, an apparatus which uses suction feeding means, and the like.

In an apparatus which uses suction feeding means, using a fan which rotates when driven by a motor as a drive source, air is blown onto a stack of sheets in a sheet feeding cassette to float the topmost sheet, and the topmost sheet which is floated is sucked and transported on a suction transportation belt.

A prior art disclosed in Japanese Unexamined Patent Publication JP-A 61-155139 (1986), for instance, is a technique for preventing wrinkles which are associated with scattering or excessive floating of sheets when the amount of a stack of sheets is small, in which a floating amount restricting member which moves in accordance with the amount of the stack of sheets is disposed above the stack of sheets, and the floating amount restricting member abuts a top surface of the stack of the sheets during sheet feeding so that even when the amount of the stack of sheets decreases, the floating amount restricting member stays abutting the top surface of the stack of sheets. According to the prior art, air is blown onto the stack of sheets from a side surface side downstream along a direction of transporting sheets to separate the bottom-most sheet from the rest of the stacked sheets, and the bottom-most sheet is sucked to the transportation belt and fed.

In a sheet feeding apparatus as described above in which air is blown onto the sheets to float the topmost or the bottom-most sheet and the sheet is sucked and transported by means of suction air (intake air), due to factors such as inherent variations in capability of a motor for a fan for blowing and sucking air, a motor for driving the suction transportation belt and the like, an external atmospheric pressure, and attaching of duct, the blowing force and the suction force upon the sheets become unstable, so that during suction attraction to the suction transportation belt, the sheets are not sucked parallel to the transportation direction but are sucked displaced, and therefore, a paper feeding error (jamming) can result.

This paper feeding error occurs particularly often in the case of sheets of a small size, since when the size of sheets is small, a sheet which is floated by blown air is positionally displaced.

Further, the related art which is disclosed in the publication requires to suck, float and feed the bottom-most sheet.

The floating amount restricting member abuts the top surface of the stack of sheets, to prevent scattering of the sheets and creasing of the sheets due to excessive floating when the amount of laid sheets becomes small, but does not aim at preventing such a paper feeding error above which particularly occurs with feeding of sheets of a small size.

SUMMARY OF THE INVENTION

Considering the problems described above, the invention aims at providing a sheet feeding apparatus in which until a sheet which is floated by sheet floating means is sucked by suction transportation means, sheets pressing means presses an edge portion of the topmost sheet from above so that the topmost sheet is confined within a restricted region by sheet position restricting of means, and hence, a paper feeding error is prevented regardless of a sheet size.

The invention provides a sheet feeding apparatus comprising:

sheet stacking means for stacking sheets;

sheet position restricting means for restricting a position of the stack of sheets in the sheet stacking means so that the stack of sheets is located within a predetermined restricted region;

sheet floating means for floating up a topmost sheet of the stack of sheets in the sheet stacking means; and suction transportation means for sucking the sheet floated up by the sheet floating means to feed to a predetermined path one by one, the sheet feeding apparatus further comprising:

comparison means for comparing a size of the sheets in the sheet stacking means with a predetermined size;

sheet pressing means, disposed above the sheet stacking means in the vicinity of an upper end portion thereof, which is constructed so as to be able to abut and separate from a top surface of the stack of sheets in the sheet stacking means; and control means for making the sheets remain within the restricted area of the sheet position restricting means, by making the sheet pressing means abut the top surface of the stack of sheets in the sheet stacking means until the topmost sheet is floated by the sheet floating means to be sucked by the suction transportation means when the size of the sheets is determined on the basis of a comparison result from the comparison means be smaller than the predetermined size, and by making the sheet pressing means separate from the top surface of the stack of sheets in the sheet stacking means when the size of the stack of sheets is determined on the basis of the comparison result from the comparison means to be equal to or larger than the predetermined size.

According to the invention, the stack of sheets in the sheet stacking means is positioned within the predetermined restricted area which is restricted by the sheet position restricting means. During paper feeding, the sheet floating means floats up the topmost sheet, and the floated sheet is sucked by the suction transportation means one by one and fed to the predetermined path. At this stage, when the size of the sheets is smaller than the predetermined size, the sheet pressing means abuts the top surface of the stack of sheets. This abutting continues until the sheet is floated and sucked. Thus, even when the size of the sheets is small, the sheets are kept within the restricted area. When the size of the sheets is equal to or larger than the predetermined size, the sheet pressing means separates from the top surface of the sheets.

In this case, the sheets are kept within the restricted area, without using the sheet pressing means.

Hence, the sheets of small size which are smaller than the predetermined size is pressed from above by the sheet pressing means at an rear end portion of the stack of sheets, and therefore, when floated by the sheet floating means, the topmost sheet is not displaced from a stack position beyond the restricted area of the sheet position restricting means, and the sheet is sucked by the suction transportation means as it is parallel to the transportation direction without fail, so that it is possible to reliably prevent a paper feeding error caused by displacement of the sheet.

Further, during transportation of sheets of a small size, when the topmost sheet is under transportation by the suction transportation means, since the sheet pressing means presses the next sheet at a rear end portion of the next sheet, there is no possibility that the next sheet will be transported together with the topmost sheet, whereby a paper feeding error is prevented without fail.

Further, the invention is characterized in that the sheet pressing means is a projection member disposed for free revolution on the sheet position restricting means.

According to the invention, it is possible to revolve the projection member disposed on the sheet position restricting means in one direction so that the projection member abuts the top surface of the sheets, and to revolve the projection member in other direction so that the projection member separates from the top surface. By means of such a revolvable projection member, it is possible to realize sheet pressing means which is relatively small and simple to control.

Further, the invention is characterized in that the sheet floating means blows air onto the sheets in the sheet stacking means from side.

According to the invention, by blowing air onto the stack of sheets from side, it is possible to float up the topmost sheet.

Further, the invention is characterized in that the sheet floating means blows air onto the sheets in the sheet stacking means from a side surface side downstream along the direction of transporting the sheets.

According to the invention, by blowing air onto the stack of sheets from the side surface side downstream along the direction of transporting the sheets, it is possible to float up the topmost sheet.

Further, the invention is characterized in that when on the basis of a comparison result obtained by the comparison means the size of the sheets is determined to be smaller than the predetermined size, the sheet floating means increases the quantity of air blast over a standard air blast quantity which is used when the size of the sheets is equal to or larger than the predetermined size.

According to the invention, when the size of the sheets is smaller than the predetermined size, a larger quantity of air than the standard air blast quantity, which is used when the size of the sheets is equal to or larger than the predetermined size, is blown. Hence, even when a distance between the topmost sheet and the suction transportation means becomes large as the sheet pressing means presses the sheets, by increasing the quantity of air which floats up a sheet, it is possible to suck the sheet parallel to the transportation direction to the suction transportation means without fail, and therefore, it is possible to prevent a paper feeding error associated with a displacement of the sheet. Instead of the quantity of air blast, the suction force of the suction transportation means may be increased.

Further, the invention is characterized in that when on the basis of a comparison result obtained by the comparison means, the size of the sheets is determined to be smaller than the predetermined size, the suction transportation means sucks a sheet for a longer suction time than a standard suction time which is used when the size of the stack of sheets is equal to or larger than the predetermined size.

According to the invention, when the size of the sheets is smaller than the predetermined size, a sheet is sucked for a longer period of time than the standard suction time which is used when the size of the stack of sheets is equal to or larger than the predetermined size. Hence, it is possible to transport a sheet at accurate timing for transportation without a delay even when the sheets are pressed by the sheet pressing means, and therefore, it is possible to prevent a paper feeding error without fail.

Further, the invention is characterized by further comprising bottom plate moving means for moving a bottom plate of the sheet stacking means upward by a predetermined quantity when on the basis of a comparison result obtained by the comparison means the size of the stack of sheets is determined to be smaller than the predetermined size.

According to the invention, when the size of the sheets is smaller than the predetermined size, the bottom plate of the sheet stacking means is moved upward a predetermined quantity. Hence, it is possible to accurately position the topmost sheet to a reference position which is at a predetermined height even when the sheets are pressed by the sheet pressing means, and therefore, it is possible to suck the topmost sheet without fail and prevent a paper feeding error.

Further, the invention is characterized in that the sheet position restricting means includes sheet width restricting means, movable along a width direction of a sheet, for restricting a position of the sheet in the sheet width direction; and sheet rear end restricting means, movable in a perpendicular direction to the sheet width direction, for restricting a position of a rear end of the sheet.

According to the invention, the stack of sheets is restricted with respect to the sheet width direction by the sheet width restricting means while restricted with respect to a position of the rear end of the stack of sheets by the sheet rear end restricting means. The sheet width restricting means is movable along the sheet width direction, while the sheet rear end restricting means is movable in the perpendicular direction to the sheet width direction, and hence, it is possible to align and lay sheets of various sizes.

Further, the invention is characterized in that the sheet pressing means is a projection member disposed so as to freely revolve on the sheet rear end restricting means.

According to the invention, specifically, the revolvable projection member is disposed on the sheet rear end restricting means. By revolving such a revolvable projection member in one direction so that the projection member abuts the top surface of the stacks of sheets, and by revolving the projection member in other direction so that the projection member separates from the top surface, it is possible to realize sheet pressing means which is relatively small and simple to control.

Further, the invention is characterized in that the suction transportation means sucks air to attract a sheet which is floated up by the sheet floating means.

According to the invention, suction attraction of a floated sheet is realized by sucking of air, and the floated sheet is fed to a predetermined path.

Further, the invention is characterized by comprising a single fan motor for air suction of the suction transportation means and for air blowing of the sheet floating means.

According to the invention, floating up of the topmost sheet of the stack of sheets is realized by air blast, suction attraction of a floated sheet is realized by sucking of air, and there is one fan motor for sucking in and blowing of air. This allows a common use of the fan motor, which in turn reduces the size of the apparatus, and makes it possible to reduce a manufacturing cost.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
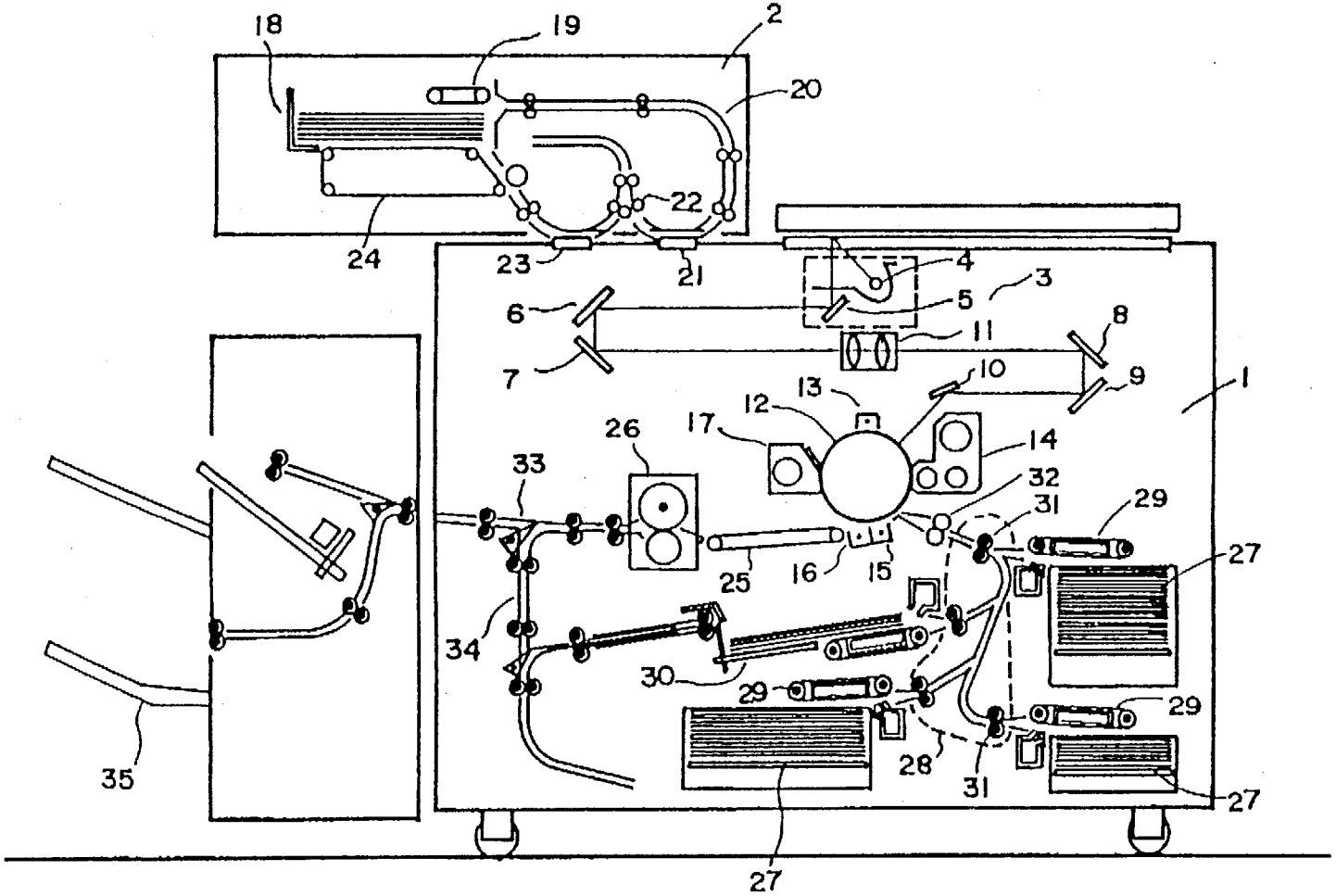
FIG. 1 is a side view schematically showing a structure of a copying machine which uses a sheet feeding apparatus according to a preferred embodiment of the invention.
Figure 2:
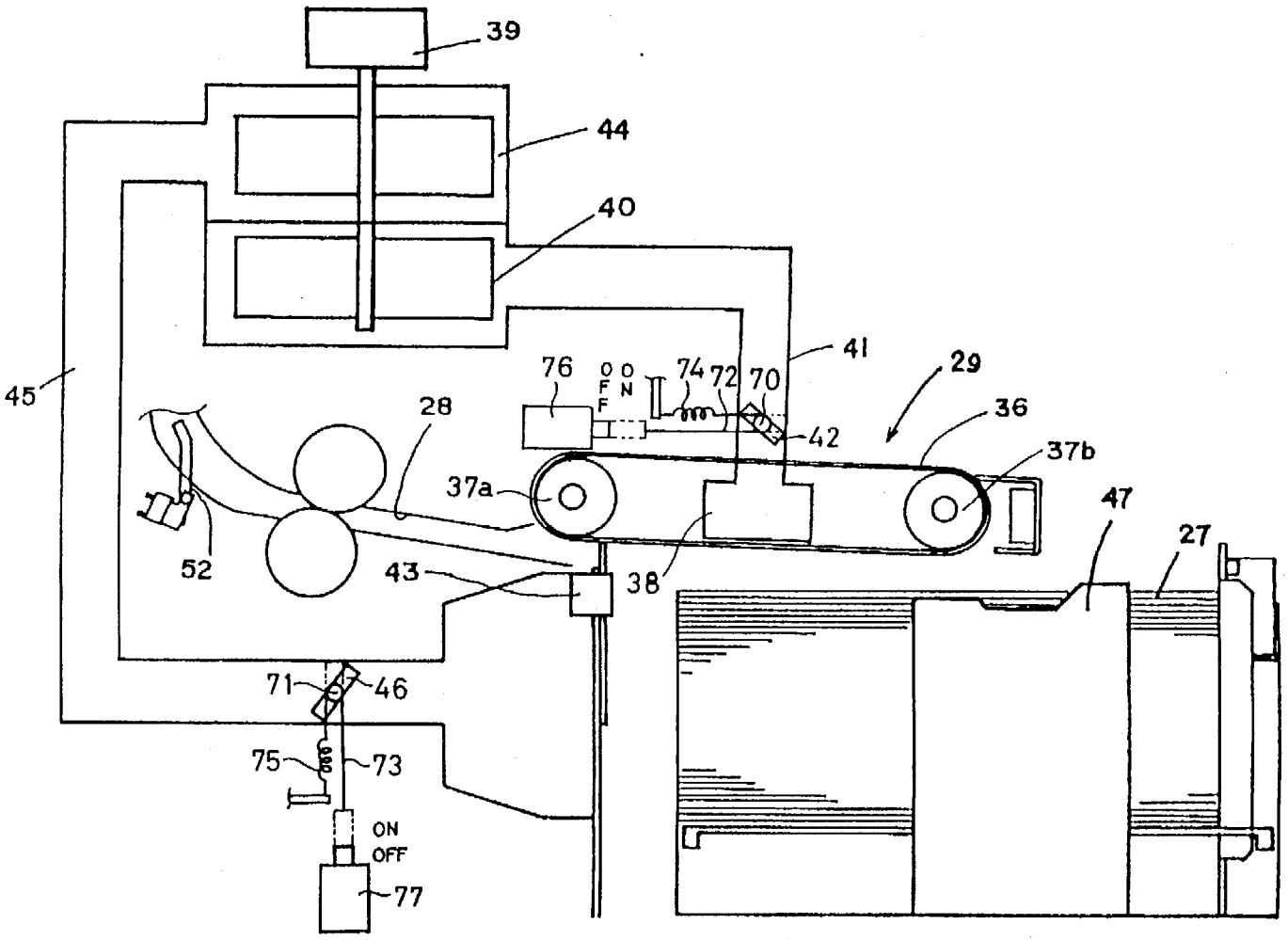
FIG. 2 is a side view schematically showing a structure of the sheet feeding apparatus.
Figure 3:
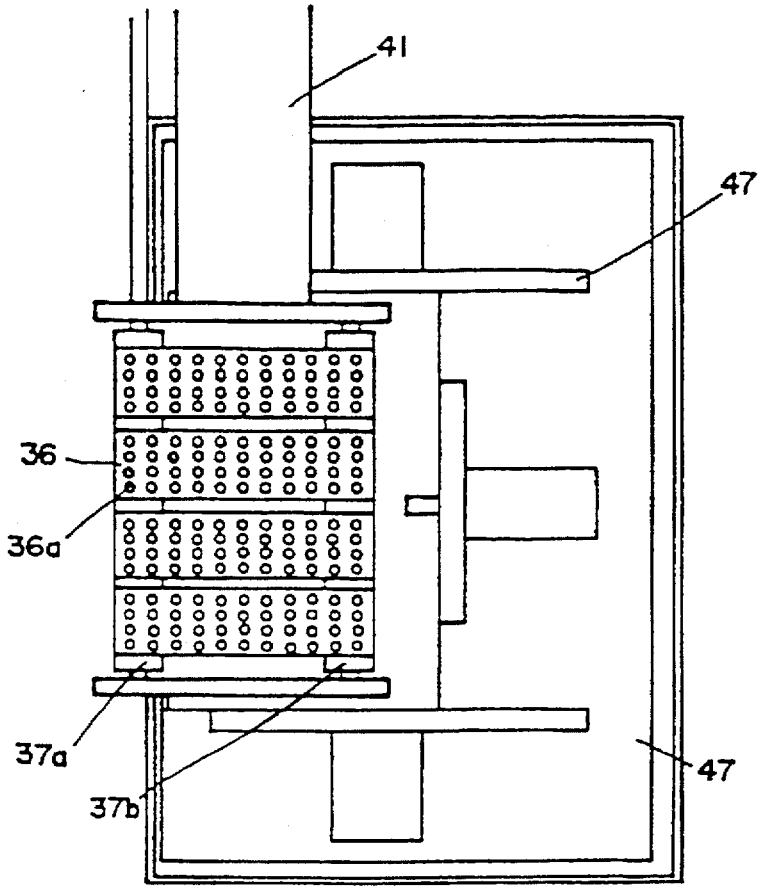
FIG. 3 is a plan view of the sheet feeding apparatus.
Figure 4:
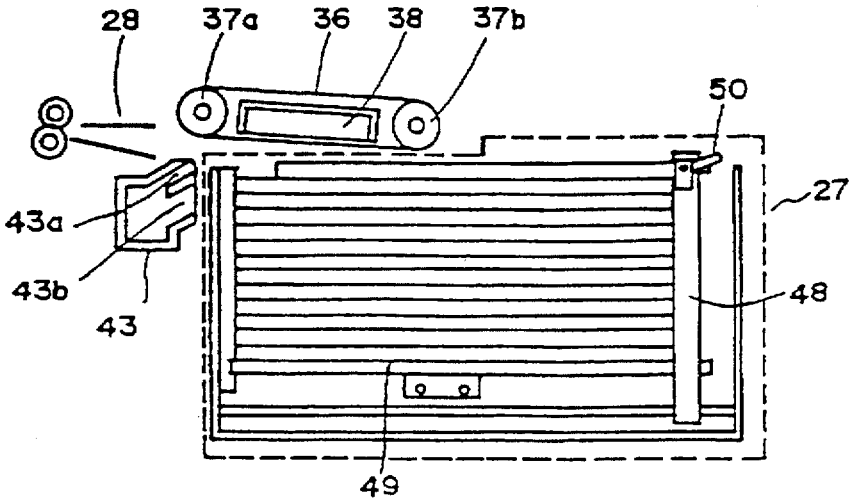
FIG. 4 is a side view showing the sheet feeding apparatus as it houses sheets of a large size.
Figure 5:
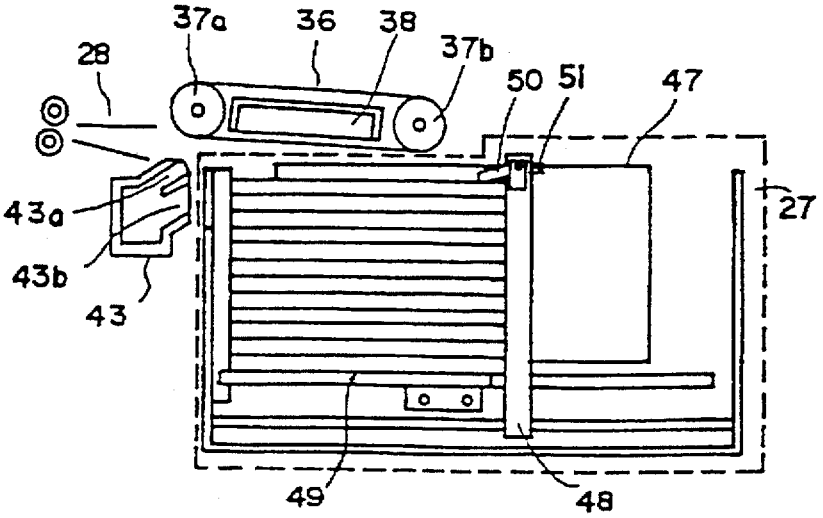
FIG. 5 is a side view showing the sheet feeding apparatus as it houses sheets of a small size.
Figure 6:
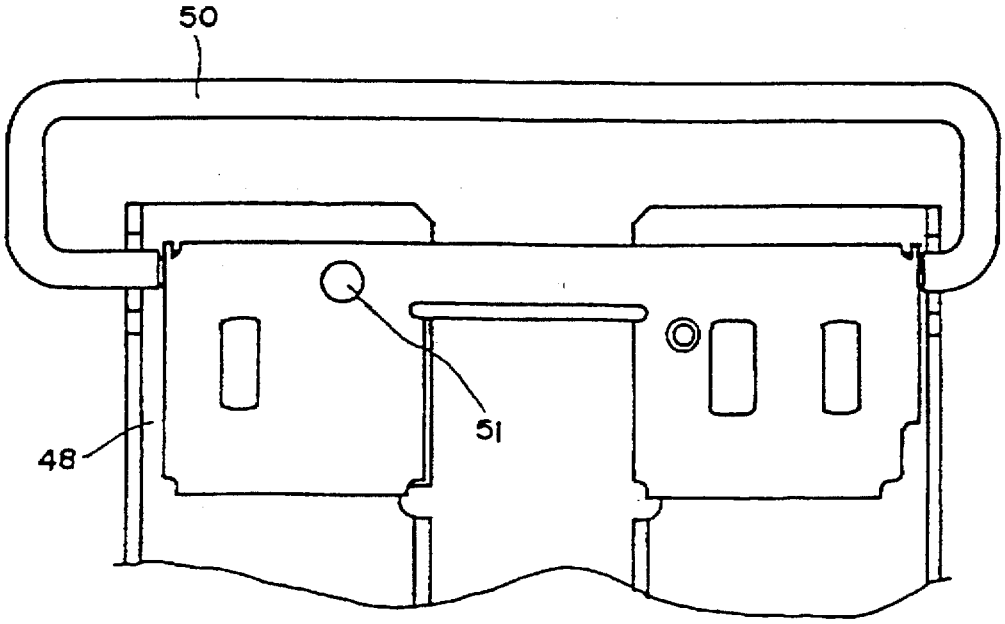
FIG. 6 is an essential side view showing a sheet pressing member of the sheet feeding apparatus.

Now referring to the drawings, preferred embodiments of the invention are described below.

The following will describe a preferred embodiment of the invention in relation to an example where a copying machine is used as a recording apparatus and a sheet feeding apparatus is applied to such a copying machine. However, the invention is not limited to an application to such an apparatus. That is, the invention is applicable to all apparatuses which handles sheets or originals from an apparatus in which sheets or originals having a cut-sheet shape are stacked on a tray or a sheet feeding cassette and which feeds the topmost sheet of the stack of sheets.

FIG. 1 is a schematic side view showing an example of a copying machine to which a sheet feeding apparatus according to a preferred embodiment of the invention is applied. The copying machine comprises a main body 1, and a portion for processing an original, that is, an RDH 2 which serves as an original feeding apparatus which sequentially transports an original to an original exposure position and returns the original to an initial position after the original is processed.

In the main body 1 of the copying machine, an optical system 3 is disposed above which exposes an original image from which an image is formed. The optical system 3 comprises a copying lamp 4 which is formed by a halogen lamp or the like, a plurality of mirrors 5 to 10, and a zoom lens 11.

A photoreceptor 12, which is a drum-like shaped recording medium and which has a photoconductive layer on a surface, is disposed for free rotation below the optical system 3. Various types of apparatuses for forming an image are disposed around the photoreceptor 12. For instance, a charging corona discharger 13, a developing part 14, a transfer corona discharger 15, a remover 16, a cleaning part 17, and the like are disposed.

The RDH 2 comprises an original housing part 18 which serves as housing means for housing originals and sheet feeding means 19 which feeds originals one by one from the original housing part 18, and an original which is fed by the sheet feeding means 19 is transported on a transportation path 20 which extends along an outer peripheral surface. A hard transparent glass plate 21 is disposed below the transportation path 20, so that a surface of an original is read and exposed. The exposed original is reversed by transportation rollers 22, the other surface of the original is read and exposed at a hard transparent glass plate 23 which is disposed below the transportation path, and the original is returned to a lower portion of the original housing part 18 by a transportation belt 24.

As driven and rotated at a constant speed in a clockwise direction, the photoreceptor 12 is charged up by the charging corona discharger 13. Reflected light passing through the optical system 3 is focused at an exposure area on the charged photoreceptor 12, so that an electrostatic latent image corresponding to the read original image is formed. The electrostatic latent image is developed into a toner image by the developing part 14. The toner image is transferred by the transfer corona discharger 15 onto a sheet which is fed to the photoreceptor 12, at a transfer area. The recorded sheet is sent to a fixing part 26 by transportation means 25. The fixing part 26 comprises a heat roller whose side contacting the overlying toner image at least is heated to a constant temperature by a heat source, and a pressure roller which applies an appropriate pressure upon the heat roller, so that the fixing part 26 heats and fixes the toner image on the sheet.

After transferring at the transfer area, electric charges remaining on the photoreceptor 12 are released by the remover 16. The residual toner on the photoreceptor 12 is removed by the cleaning part 17 which is disposed downstream to the transfer area in a direction of rotation of the photoreceptor 12.

The sheet feeding apparatus for feeding sheets according to the invention is disposed below the main body 1. The sheet feeding apparatus comprises a sheet feeding cassette 27 which houses sheets which are mounted to a side portion of the main body 1, and a sheet feeding suction part 29 which takes the sheets which are housed in the sheet feeding cassette 27 one by one from the top so as to feed the sheets to a sheet feeding path 28.

This sheet feeding operation is realized as the sheet feeding suction part 29 which is disposed on the upper surface of the sheet feeding cassette 27 is driven and rotated by a drive motor for sheet feeding which is not shown.

In the sheet feeding path 28 and a sheet feeding path leading from an intermediate tray 30 which will be described later, transportation rollers for sheet feeding 31 are disposed. As the transportation rollers for sheet feeding 31 are driven and rotated by the drive motor not shown, a sheet is supplied to the transfer area. Transportation is suspended when a leading end portion of a sheet, which is transported to the photoreceptor 12 from the sheet feeding cassette 27 and the intermediate tray 30, reaches PS rollers 32.

Following this, synchronization is performed so that a side end portion downstream along the moving direction of the toner image of the photoreceptor 12 coincides with the leading end portion of the sheet.

A discharge path 33 is disposed for discharging a sheet which was subjected to a transfer (copying) process and passed the fixing part 26, and a diverge path for reversing sheets 34 is disposed to divert from the discharge path 33. The sheet which went through the copying process and passed the fixing part 26 and hence now has an image corresponding to the original copied to the surface is discharged to a discharge tray 35 in three ways described below in accordance with a mode of copying an operator wishes.

(a) The sheet travels as it is on the discharge path 33, and is discharged to the discharge tray 35.

(b) To copy on the other surface of the sheet, the sheet is switched back (i.e., reversed up side down) on the diverge path for reversing sheets 34 after transported toward the discharge path 33, and housed temporarily in the intermediate tray 30 once again so that the sheet will be sent to the transfer area once again. The sheets stacked in the intermediate tray 30 are taken out sequentially from the bottom and fed to the transfer area through the sheet feeding path 28, and the sheets are then discharged to the discharge tray 35 through the discharge path 33, past the fixing part 26.

(c) The sheet is reversed on the diverge path for reversing sheets 34 after transported toward the discharge path 33, and discharged to the discharge tray 35 from the discharge path 33.

As shown in FIGS. 2 to 6, in the sheet feeding apparatus above, the sheet feeding suction part 29 is disposed above the sheet feeding cassette 27. In the sheet feeding suction part 29, a suction transportation belt 36 is stretched about a drive roller 37*a* and a driven roller 37*b*, and an air intake opening 38 is formed inside the suction transportation belt 36, so that the drive roller 37*a* feeds a sucked sheet to the sheet feeding path 28 when rotated by a drive motor not shown.

The air intake opening 38 is linked to an air intake fan 40 which is driven by a motor 39, through an air intake duct 41. A switching valve 42 for adjusting the suction force is disposed within the air intake duct 41. Air is sucked in through the air intake opening 38 through a suction hole 36*a*, which is formed in the suction transportation belt 36, by means of the suction force of the air intake fan 40, so that the topmost sheet in the sheet feeding cassette 27 is suction attracted to the sheet feeding belt 36.

On the side taken along sheet feeding of the sheet feeding cassette 27, an air blast nozzle 43 is disposed which includes a first air blast outlet 43*a*, through which air is blown onto the stack of sheets in the sheet feeding cassette 27 from a side surface side downstream in the sheet transportation direction to thereby float up the topmost sheet, and a second air blast outlet 43*b* for separating the topmost sheet which is floated up by the first air blast outlet 43*a* from the underlying sheets.

The air blast nozzle 43 is linked to an air blast fan 44 which is driven by the motor 39, through an air blast duct 45, and a switching valve 46 for adjusting the air blast force is formed within the air blast duct 45.

Around switching axes 70 and 71 of the switch valves 42 and 46 are wound wires 72 and 73, respectively, at one end portions of which springs 74 and 75 are fixed, and at the other end portions of which solenoids 76 and 77 are fixed. When the solenoids 76 and 77 are off, the switching valves 42 and 46 are opened by an angle corresponding to air blast quantity, and when the solenoids 76 and 77 are on, the switching valves 42 and 46 are closed by urging force of the springs 74 and 75.

The suction transportation belt 36 is composed of several narrow belts arranged to adjoin to one another, which are stretched about the drive roller 37*a* and the driven roller 37*b*. A plurality of suction holes 36*a* for passing air are formed in each belt. A bottom surface of the suction transportation belt 36 is disposed along the top surface of the sheet feeding cassette 27.

In the sheet feeding cassette 27, a sheet width restricting guide 47 for preventing feeding of a sheet in a slanted direction, is disposed to a back surface of the sheet feeding cassette 27 which faces a front face of the main body 1, and a sheet rear end restricting plate 48 for guiding a rear end of a sheet is disposed to an upstream portion in the sheet transportation direction. The sheet width restricting guide 47 and the sheet rear end restricting plate 48 are disposed for free sliding in accordance with a size of sheets.

Further, a sheet feeding bottom plate 49 is disposed to the sheet feeding cassette 27 for free upward and downward movement, so that as the sheet feeding bottom plate 49 moves upward, the topmost sheet is positioned to a predetermined position at a predetermined height regardless of the quantity of the stack of sheets.

A sheet pressing member 50 is disposed for free rotation to a top end portion of the sheet rear end restricting plate 48. The sheet pressing member 50 revolves toward a sheet and presses the sheet at a rear end of the sheet from above when a size of the sheet is a small size which is smaller than a predetermined size, but revolves away from a sheet and stops pressing the sheet at a rear end of the sheet when the size of the sheet is a large size which is larger than the predetermined size.

Denoted at 51 is a restricting projection which restricts revolution of the sheet pressing member 50 in the direction away from a sheet.

Revolution of the sheet pressing member 50 is realized by a motor, in such a manner that the sheet pressing member 50 is revolved to press a sheet at a rear end of the sheet from above when a size of the sheet is a small size which is smaller than a predetermined size, but is revolved in a direction for releasing pressing of the sheet at a rear end of the sheet when the size of the sheet is a large size which is larger than the predetermined size.

Alternatively, revolution of the sheet pressing member 50 may be realized in such a manner that urging force of an elastic member such as a spring revolves the sheet pressing member 50 in one direction and a motor, a solenoid or the like revolves the sheet pressing member 50 in the other direction.

In such a structure described above, the sheets are laid on the sheet feeding bottom plate 49 which is mounted to the sheet feeding cassette 27 for free upward and downward movement. The positions of the sheets in the width direction are determined by the sheet width restricting guide 47, the leading end and the rear end positions of the sheets are determined by the sheet rear end restricting plate 48, and the sheets are moved to a reference position, to which a sheet is fed, as the sheet feeding bottom plate 49 moves upward.

Figure 7:
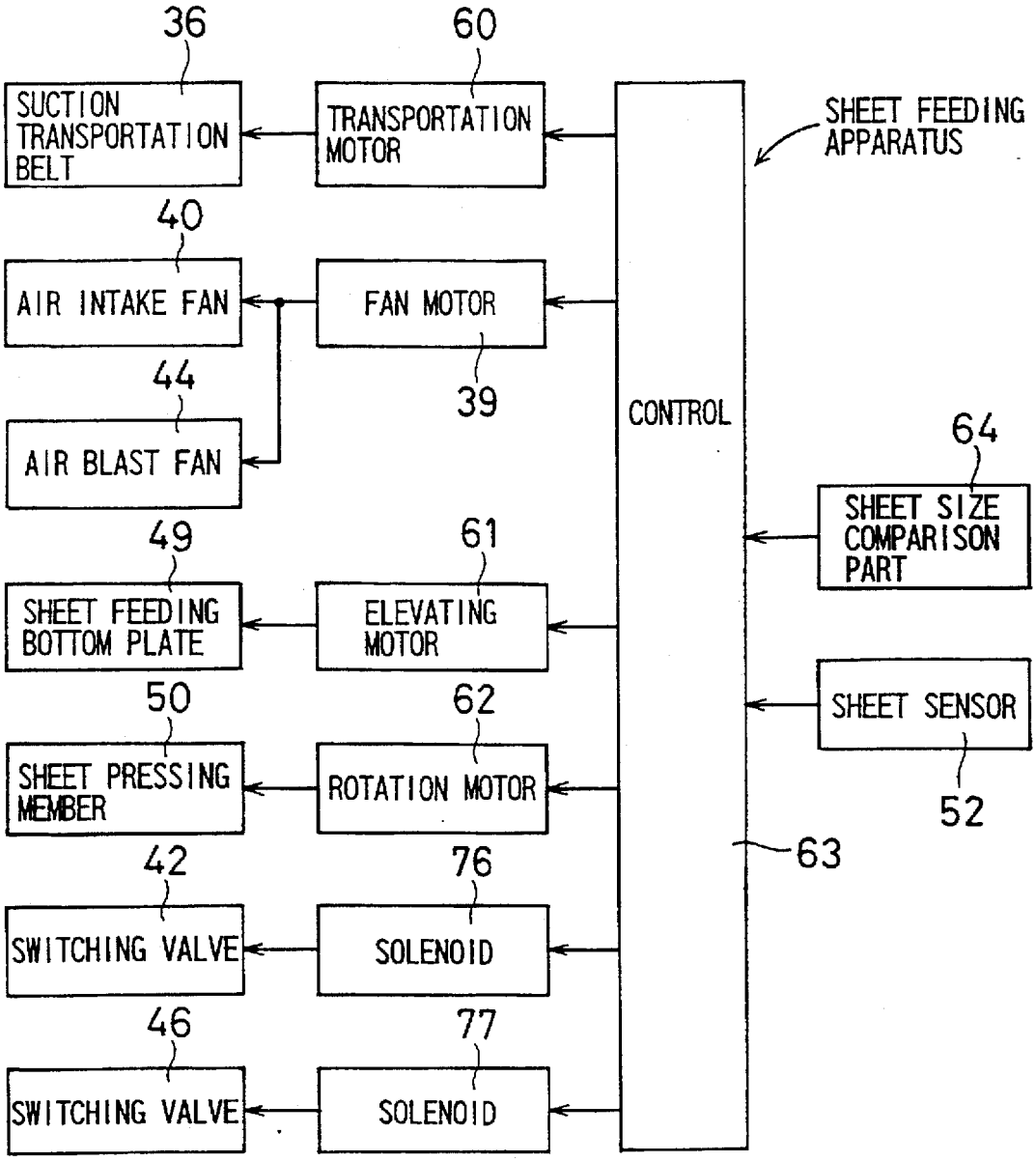
FIG. 7 is a block diagram showing an electric structure of the sheet feeding apparatus.
Figure 8:
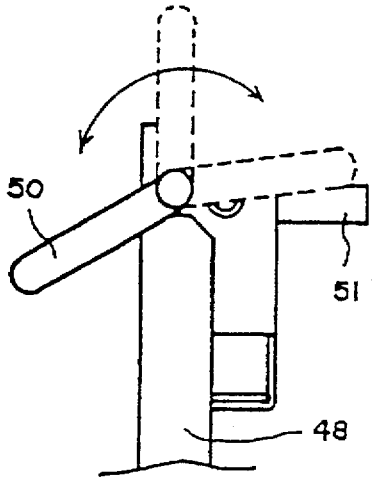
FIG. 8 is a side view showing the sheet pressing member as it is when the sheet feeding apparatus houses sheets of a large size.

FIG. 7 is a block diagram showing an electric structure of the sheet feeding apparatus. The sheet feeding apparatus comprises a transportation motor 60 which drives the suction transportation belt 36, the fan motor 39 which drives the air intake fan 40 and the air blast fan 44, an elevating motor 61 which moves the sheet feeding bottom plate 49 upward and downward, a rotation motor 62 which rotates the sheet pressing member 50, the solenoids 76 and 77 which drive the switching valves 42 and 46, respectively, a sheet sensor 52, a sheet size comparison part 64, and a control part 63.

The control part 63 starts the paper feeding operation in accordance with the copying operation by the main body 1, and controls operations of the motors 39 and 60 to 62 and the solenoids 76 and 77. The solenoids 76 and 77 are usually off. First, the fan motor 39 is turned on so that the air blast fan 44 floats up the topmost sheet, and by means of the air intake fan 40, the floated sheet is suction attracted to the suction transportation belt 36. Next, the transportation motor 60 is turned on so that the suction attracted sheet is transported to the sheet feeding path 28. In response to a detection result from the sheet sensor 52, the control part 63 judges that the transported sheet moved past the sheet feeding path 28 and turns off the motors 39 and 60.

The sheet size comparison part 64 compares the size of the sheets in the sheet feeding cassette 27 with the predetermined size, and supplies a result of the comparison to the control part 63. Based on the result of the comparison, the control part 63 drives the elevating motor 61 and the rotation motor 62 in accordance with the size of the sheets. For example, where a reference position is the bottom-most position, when the sheet feeding bottom plate 49 is disposed always at the reference position, the elevating motor 61 is turned on to move the bottom plate 49 upward, and is then turned off so that the bottom plate 49 is held at this position. To move down the bottom plate 49, the elevating motor 61 is turned on to rotate in the reverse direction. Further, where a reference position is on the sheets side, when the sheet pressing member 50 is positioned at the reference position, for instance, the rotation motor 62 is turned on to revolve the sheet pressing member 50 away from the sheets, and is then turned off so that the sheet pressing member 50 is held at this position. To revolve the sheet pressing member 50 toward the sheets, the rotation motor 62 is turned on to rotate in the reverse direction.

In the case where the size of the sheets is equal to or larger than the predetermined size, as shown in FIGS. 8 to 11, the sheet pressing member 50 is revolved by the motor 62 in a direction away from the rear end side of the sheets, so that pressing of the sheets at rear ends of the sheets is released. Note in FIGS. 8–15, some of the elements referred to, are illustrated in other figures of the drawings.

The motor 39 rotates the air intake fan 40 and the air blast fan 44, and the switching valves 42 and 46 are opened when the rotation speed of the motor 39 reaches a predetermined number of revolutions.

Figure 9:
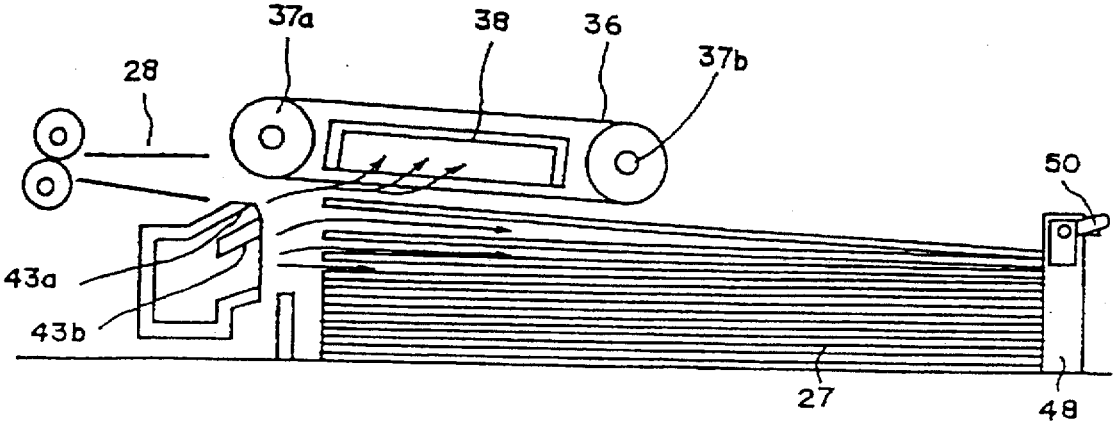
FIGS. 9 to 11 are side views for describing an operation of feeding sheets of a large size which are housed in the sheet feeding apparatus.

Following this, as shown in FIG. 9, as the air blast fan 44 rotates, air is blown onto the stack of sheets in the sheet feeding cassette 27 from the first air blast outlet 43*a* and the second air blast outlet 43*b* through the air blast duct 45, whereby the topmost sheet of the sheets in the sheet feeding cassette 27 is floated up by the air blast from the first air blast outlet 43*a* and then separated from the underlying sheets by the air blast from the second air blast outlet 43*b*.

Figure 10:
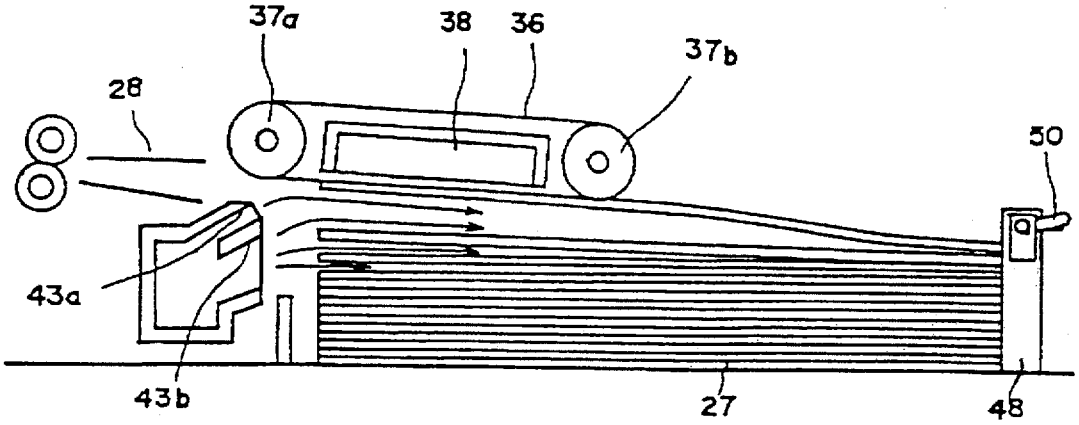

Next, as shown in FIG. 10, as the air intake fan 40 rotates, air is sucked in (air intake) from the air intake opening 38 through the suction holes 36*a* which are formed in the suction transportation belt 36, so that the topmost sheet which is floated up by the operation above is suction attracted to the suction transportation belt 36.

Figure 11:
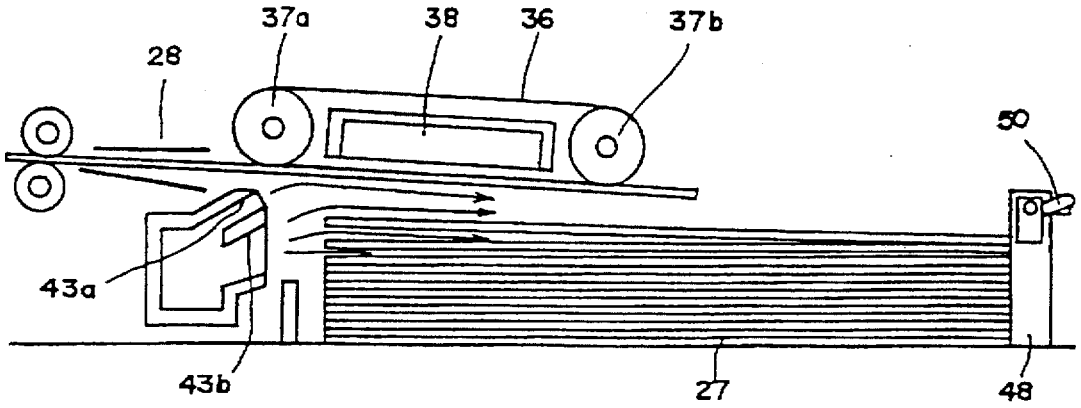
Figure 12:
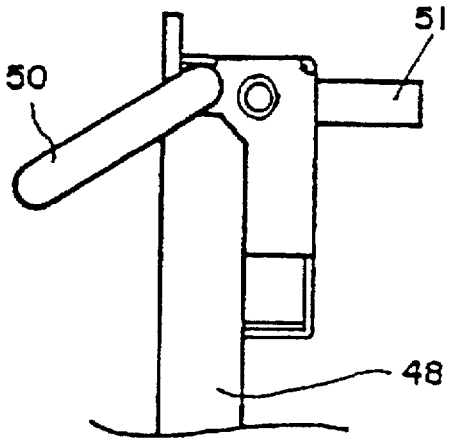
FIG. 12 is a side view showing the sheet pressing member as it is when the sheet feeding apparatus houses sheets of a small size.

As the suction transportation belt 36 rotates, as shown in FIG. 11, the suction attracted sheet is transported to the sheet feeding path 28.

Upon sensing of the transported sheet by the sheet sensor 52 which is disposed in the sheet feeding path 28, the solenoid 76 turns on, then the switching valve 42 of the air intake duct 41 is closed so that the suction force from the air intake opening 38 is shut off.

The sheet is then transported, and when the next sheet becomes ready for feeding (transportation), the solenoid 76 turns off, then the switching valve 42 of the air intake duct 41 is opened again so that the next sheet is sucked from the sheet feeding cassette 27 and transported.

On the other hand, when the size of the sheets is a small size which is smaller than the predetermined size, as shown in FIGS. 12 to 15, the sheets are stacked on the sheet feeding bottom plate 49 which is mounted to the sheet feeding cassette 27 for free upward and downward movement. The positions of the sheets in the width direction are determined by the sheet width restricting guide 47, the leading end and the rear end positions of the sheets are determined by the sheet rear end restricting plate 48, and the sheet feeding bottom plate 49 is moved to a position which is higher than the reference position by a predetermined amount, e.g., 0.5 to 1.0 cm.

This is carried out to prevent a situation that as the sheet pressing member 50 presses the sheets at the rear ends of the sheets from above, the topmost sheet is positioned at lower height than when the sheets have a large size and a time until the topmost sheet is suction attracted to the suction transportation belt 36 accordingly becomes long so that the sucked sheet is transported at delayed timing and a paper feeding error is consequently created.

The sheet pressing member 50 is revolved by the motor 62 toward the rear ends of the sheets, and presses the sheets from above.

Figure 13:
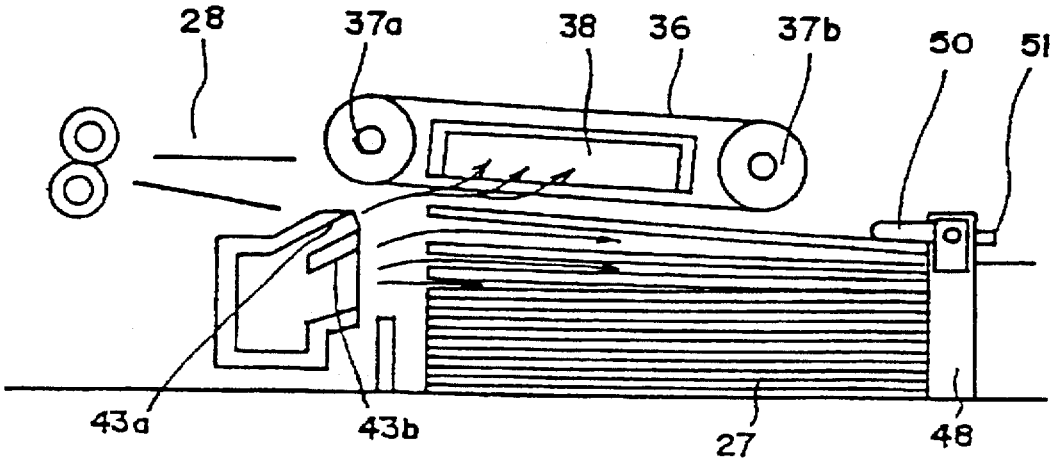
FIGS. 13 to 15 are side views for describing an operation of feeding sheets of a small size which are housed in the sheet feeding apparatus.

The motor 39 rotates the air intake fan 40 and the air blast fan 44, and the switching valves 42 and 46 are opened when the rotation speed of the motor 39 reaches a predetermined number of revolutions. As a result, as shown in FIG. 13, as the air blast fan 44 rotates, air is blown onto the stack of sheets in the sheet feeding cassette 27 from the first air blast outlet 43*a* and the second air blast outlet 43*b* through the air blast duct 45, whereby the topmost sheet of the stack of sheets in the sheet feeding cassette 27 is floated up by the air blast from the first air blast outlet 43*a* and then separated from the underlying sheets by the air blast from the second air blast outlet 43*b*.

Figure 14:
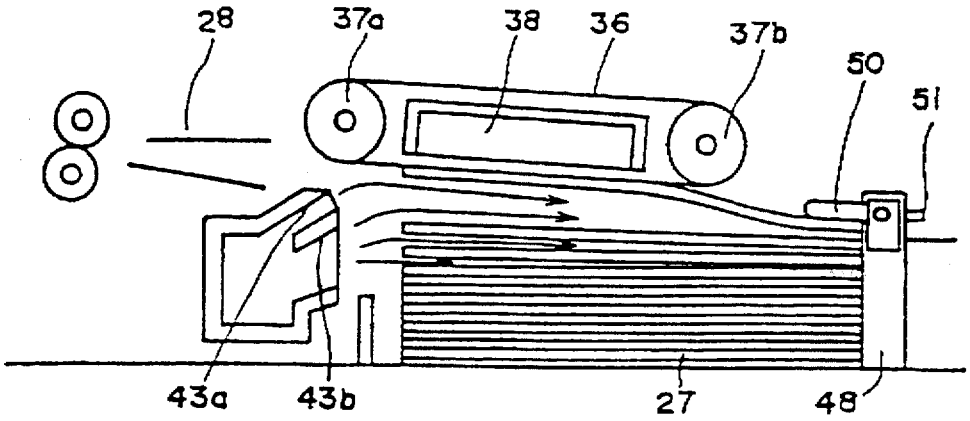

At this stage, since the sheet pressing member 50 presses the sheets at the rear ends of the sheets from above, there is no possibility that the sheets will be displaced beyond a restricted area which is defined by the sheet width restricting guide 47 and the sheet rear end restricting plate 48. As shown in FIG. 14, as the air intake fan 40 rotates, air is sucked in (air intake) from the air intake opening 38 through the suction holes 36*a* of the suction transportation belt 36, so that the topmost sheet which is floated up by the operation above is suction attracted to the suction transportation belt 36 without positionally displaced.

Figure 15:
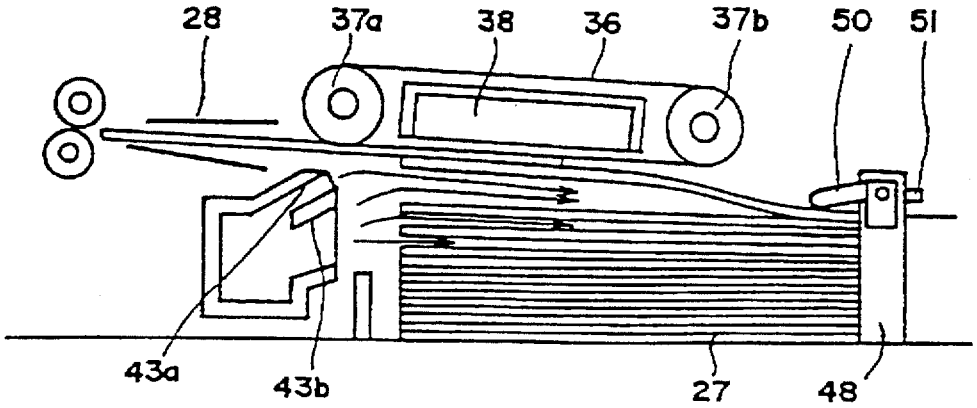

As the suction transportation belt 36 rotates, as shown in FIG. 15, the suction attracted sheet is transported to the sheet feeding path 28. Upon sensing of the transported sheet by the sheet sensor 52 which is disposed in the sheet feeding path 28, the solenoid 76 turns on, then the switching valve 42 of the air intake duct 41 is closed so that the suction force from the air intake opening 38 is shut off.

The sheet is then transported, and when the next sheet becomes ready for feeding (transportation), the solenoid 76 turns off, then the switching valve 42 of the air intake duct 41 is opened again so that the next sheet is sucked from the sheet feeding cassette 27 and transported.

When the rear end of the topmost sheet is moved off the position at which the rear end is pressed by the sheet pressing member 50 as the topmost sheet is transported is transported by means of the suction transportation belt 36 as described above, since the rear end of the next sheet is pressed by the sheet pressing member 50, it is possible to prevent without fail the next sheet from getting transported together with the topmost sheet.

Further, instead of moving up the sheet feeding bottom plate 49 beyond the reference position by the predetermined amount, the motor 39 may be rotated at higher number of revolutions than that of when the sheets have a large size, to thereby suction attract the sheets by means of increased suction force and air blast force. When the sheets have a small size, since the rear end of the sheet is pressed by the sheet pressing member 50, a distance between the topmost sheet and the suction transportation belt 36 becomes large and the suction force upon the sheets is weakened, and therefore, by increasing the number of revolutions of the motor 39, it is possible to reliably suction attract the sheets by means of the suction force and the air blast force which are increased.

Still further, instead of as described above, the timing of rotating the suction transportation belt 36 may be quickened to occur before reference timing, to thereby drive the suction transportation belt 36 for a longer period of time than a standard time. When the suction transportation belt 36 rotates and starts transportation, pressing of the sheets at the rear ends by the sheet pressing member 50 shifts the timing of transporting the sheets so that a paper feeding error occurs. However, as described above, by quickening the timing of rotating the suction transportation belt 36 and accordingly extending the drive time, it is possible to prevent shifting of the timing of transportation, and hence, a paper feeding error without fail.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet feeding apparatus comprising:

sheet stacking means for stacking sheets;

sheet position restricting means for restricting a position of the stack of sheets in the sheet stacking means so that the stack of sheets is located within a predetermined restricted region;

sheet floating means for floating up a topmost sheet of the stack of sheets in the sheet stacking means; and suction transportation means for sucking the sheet floated up by the sheet floating means to feed to a predetermined path one by one, the sheet feeding apparatus further comprising:

comparison means for comparing a size of the sheets in the sheet stacking means with a predetermined size;

sheet pressing means, disposed above the sheet stacking means in the vicinity of an upper end portion thereof, which is constructed so as to be able to abut and separate from a top surface of the stack of sheets in the sheet stacking means; and control means for making the sheets remain within the restricted area of the sheet position restricting means, by making the sheet pressing means abut the top surface of the stack of sheets in the sheet stacking means until the topmost sheet is floated by the sheet floating means to be sucked by the suction transportation means when the size of the sheet is determined on the basis of a comparison result from the comparison means be smaller than the predetermined size, and by making the sheet pressing means separate from the top surface of the stack of sheets in the sheet stacking means when the size of the sheets is determined on the basis of the comparison result from the comparison means to be equal to or larger than the predetermined size.

2. The sheet feeding apparatus of claim 1, wherein the sheet pressing means is a projection member disposed for free revolution on the sheet position restricting means.

3. The sheet feeding apparatus of claim 1, wherein the sheet floating means blows air onto the stack of sheets in the sheet stacking means from side.

4. The sheet feeding apparatus of claim 3, wherein the sheet floating means blows air onto the stack of sheets in the sheet stacking means from a side surface side downstream along the direction of transporting the sheets.

5. The sheet feeding apparatus of claim 3, wherein, when on the basis of a comparison result obtained by the comparison means the size of the sheets is determined to be smaller than the predetermined size, the sheet floating means increases the quantity of air blast over a standard air blast quantity which is used when the size of the sheets is equal to or larger than the predetermined size.

6. The sheet feeding apparatus of claim 1, wherein when on the basis of a comparison result obtained by the comparison means the size of the sheets is determined to be smaller than the predetermined size, the suction transportation means sucks a sheet for a longer suction time than a standard suction time which is used when the size of the sheets is equal to or larger than the predetermined size.

7. The sheet feeding apparatus of claim 1, further comprising bottom plate moving means for moving a bottom plate of the sheet stacking means upward by a predetermined quantity when on the basis of a comparison result obtained by the comparison means the size of the sheets is determined to be smaller than the predetermined size.

8. The sheet feeding apparatus of claim 1, wherein the sheet position restricting means includes sheet width restricting means, movable along a width direction of a sheet, for restricting a position of the sheet in the sheet width direction; and sheet rear end restricting means, movable in a perpendicular direction to the sheet width direction, for restricting a position of a rear end of the sheet.

9. The sheet feeding apparatus of claim 8, wherein the sheet pressing means is a projection member disposed so as to freely revolve on the sheet rear end restricting means.

10. The sheet feeding apparatus of claim 1, wherein the suction transportation means sucks air to attract a sheet which is floated up by the sheet floating means.

11. The sheet feeding apparatus of claim 1, comprising a single fan motor for air suction of the suction transportation means and for air blowing of the sheet floating means.

* * * * *